United States Patent [19]

Massaux

[11] 4,439,110

[45] Mar. 27, 1984

[54] CONTROLLING AND REGULATING DEVICE FOR PUMPS WITH CONSTANT VOLUME

[76] Inventor: Jean G. Massaux, 50 rue de Dinant - B -, 6302 Gougnies, Belgium

[21] Appl. No.: 355,487

[22] Filed: Mar. 8, 1982

Related U.S. Application Data

[63] Continuation of Ser. No. 95,261, Nov. 19, 1979, abandoned.

[30] Foreign Application Priority Data

Nov. 21, 1978 [BE] Belgium ..... 191850

[51] Int. Cl.[3] ..... F04F 1/06

[52] U.S. Cl. ..... 417/129; 417/131; 417/138; 417/290

[58] Field of Search ..... 417/129, 131, 138, 290

[56] References Cited

U.S. PATENT DOCUMENTS

| | | | |
|---|---|---|---|
| 1,056,709 | 3/1913 | Pollacek | 417/129 |
| 2,982,467 | 5/1961 | Corson et al. | 417/290 X |
| 3,556,682 | 1/1971 | Sakamoto et al. | 417/102 |
| 3,907,462 | 9/1975 | Kroeger | 417/138 X |
| 3,991,825 | 1/1976 | Morgan | 417/138 X |
| 4,037,992 | 7/1977 | Uchida et al. | 417/102 |

*Primary Examiner*—Richard E. Gluck

*Attorney, Agent, or Firm*—Sughrue, Mion, Zinn, Macpeak and Seas

[57] ABSTRACT

A device for controlling the performance of pumps, having a constant volume such as pneumatic pumps having a constant volume, comprises liquid level detectors, such as magnetic microswitches that cooperate with a magnetized float, and the detectors are adapted to control the filling and delivery operation of pumped liquid into and out of a pump body.

The device may comprise three or more liquid level detectors and a timing device for the filling and/or delivery operation of the pump, at least one of said detectors being adapted to control said timing device and the other liquid level detectors being adapted to control the filling and delivery operation itself.

8 Claims, 3 Drawing Figures

CONTROLLING AND REGULATING DEVICE FOR PUMPS WITH CONSTANT VOLUME

This is a continuation, of application Ser. No. 95,261 filed Nov. 19, 1979, now abandoned.

BACKGROUND OF THE INVENTION

1. Field of the Invention

The present invention relates to a new device for controlling the performance of pumps having a constant volume, in particular for pneumatic pumps having a constant volume.

In their non-sucking version, working with compressed air or any other pressurized gas, such pumps are commonly used for pumping pulps and sludges of any kind (charged or uncharged liquids, acid or not) the temperatures of which do not exceed 100° C. in general.

Under some acidity and abrasive conditions to which pneumatic pumps are commonly submitted, centrifugal pumps have the drawback that they require frequent replacing of the rotors, which is very expensive both for the replacement parts and for dissassembling and remounting.

For pneumatic pumps with membranes, the life-time thereof does scarcely exceed a few months even in the most favorable conditions.

This is the reason why pneumatic pumps without membranes find an important field of application, in particular in the draining of decantation vessels and open air tanks.

2. Description of the Prior Art

The main drawback of the pneumatic pumps with a constant volume was however, until now, the absence of any efficient regulation of their performance.

The performance of such pumps may indeed theoretically be controlled in two different ways: either by subjecting the admission and evacuation of pressurized gas to the level of liquid in the pump body, or by timing the relative duration of the admission and the evacuation of the pressurized gases.

The first method has however, until now, the drawback that there was no means both sufficiently inexpensive and reliable for detecting the level of charged liquids.

The second method has on the other hand never led to any satisfactory results in practice, because the important changes of drop of charge when pumping pulps and sludges, often gave rise to the carrying along of compressed air at the pump outlet during delivery of pumped liquid, and/or to overfilling of the pump body during "aspiration" (evacuation of compressed air), owing to an uneasy timing of the duration of admission and/or evacuation of the pressurized gas.

It is known to provide a device for controlling the performance of pumps comprising a pump body for the filling/delivery of a fluid, more in particular for pneumatic pumps without membranes, which device avoids the above stated drawbacks.

Said device therefor comprises liquid level detectors which cooperate with a float in order to control the filling and delivery operation of pumped liquid into and out of the pump body.

SUMMARY OF THE INVENTION

It is an object of the present invention to provide a device comprising timing device for the filling and/or delivery operation of the pump, at least one of said detectors being adapted to control said timing device and the other liquid level detectors being adapted to control the filling and delivery operation itself.

According to a first feature of the invention, the new control device comprises:

- a magnetized float, provided inside the pump body and adapted to move with the level of the pumped fluid according to a guided trajectory, and
- at least two magnetic switches placed at different levels along the trajectory of the magnetized float, adapted to be actuated by said float, and adapted to control the filling and delivery operation of the pumped fluid into and out of the pump body.

According to another feature of the invention, the new control device comprises:

- at least three detectors for detecting the level of the pumped fluid in the pump body, and
- a timing device for the filling or delivery operation of the pump,
  - two of the level detectors being adapted to control the filling and delivery opertion of the pumped fluid,
- and one detector being adapted to control said timing device.

A very suitable control device, in accordance with this invention therefore comprises:

- one magnetized float, provided inside the pump body and adapted to move with the level of the pumped fluid according to a guided trajectory;
- a timing device for the filling or delivery operation of the pump;
- at least three magnetic switches placed at different levels along the trajectory of the magnetized float, adapted to be actuated by said float;
- two magnetic switches being adapted to control the filling and delivery operation of the pumped fluid and one magnetic switch at least being adapted to control said timing device.

As stated above, the control devices according to the invention are particularly interesting for controlling the performance of pneumatic pumps without membranes, said pumps comprising a pump body, admission and evacuation valves for the pressurized gas in the pump body, and non-return valves for the filling and the delivery of the pumped fluid into and out of from the pump body; in such case said switches and detectors provided to control the filling and the delivery operation of the pumped fluid serve to control the mechanisms for the opening, and the closing of the admission, and evacuation valves for the pressurized gas.

In a preferred embodiment of a control device comprising a magnetized float and magnetic switches, according to one feature of the invention, the control function may, according to the invention, be achieved by an electric control assembly comprising:

- a first relay actuated by a first magnetic switch corresponding to the upper level of the liquid in the pump operation, said first relay being placed in series with said first magnetic switch;
- a second relay actuated by a second magnetic switch, corresponding to the lower level of the liquid in the pump operation, said second relay being placed in series with said second magnetic switch;
- interconnected in such manner that the normally closed first contact of said first relay is connected to a control mechanism for the opening of the (normally closed) valve(s) for the evacuation of the pressurized gas, and, the normally closed contact of the first relay is connected in series with the normally open second contact of said second relay and with said second relay, said contacts in series being connected in parallel with said second magnetic switch;

and the normally open first contact of said first relay is connected to a control mechanism for the opening of the (normally closed) valve(s) for the admission of pressurized gas, the normally opened second contact of the first relay is connected in series with the normally closed contact of said second relay and with said first relay, said contacts in series being connected in parallel with said first magnetic switch.

In a preferred embodiment of a control device a magnetized float and magnetic switches being used as liquid level detectors cooperating with a timing device, according to another feature of the invention, in which the admission and evacuation valve(s) for the pressurized gas are controlled by a normally closed mechanism, the control function may, in accordance with the invention be achieved by an electric control assembly comprising:

a first relay actuated by a first switch pertaining to or influenced by the liquid level detector corresponding to the upper level of the liquid in the pump operation, said first relay being placed in series with said first switch;

a second relay, actuated by a second switch pertaining or influenced by the liquid level detector corresponding to the lower level of the liquid in the pump operation, said second relay being placed in series with said second switch;

a third relay, actuated by a third switch pertaining to or influenced by the liquid level detector corresponding to the intermediate level of liquid in the pump operation, said third relay being placed in series with third switch;

an intermittent relay operating when the electric control assembly of the device is electrically connected; interconnected in such manner that:

the normally closed contact of said first relay is connected, in series with the normally closed contact of said third relay, to the control mechanism for the opening of the evacuation valve(s) for the pressurized gas, and, in series with the normally opened second contact of said second relay and with said second relay, said normally closed second contact of said first relay and normally opened second contact of said second relay, connected in series, being placed as a parallel assembly to said second switch;

the normally opened first contact of said first relay is connected to the control mechanism for the opening of the admission valve(s) for the pressurized gas, and, the normally opened second contact of said first relay is connected in series with the normally closed contact of said second relay and with said first relay, said normally closed contact of said second relay and normally opened second contact of said first relay, connected in series, being placed as a parallel assembly to said first switch;

the normally closed contact of said intermittent relay is connected in series with said parallel assembly of said second switch and with the normally closed second contact of said first relay and the normally opened second contact of said second relay.

In a preferred embodiment of a control device comprising a magnetized float and magnetic switches cooperating with a timing device, in accordance with the most interesting features of the invention, wherein the admission and evacuation valves of the pressurized gas are controlled by a normally closed control mechanism, the control function may in accordance with the invention, be achieved by an electric control assembly similar to the assembly described hereabove for the preferred embodiment of a control device comprising liquid level detectors of any kind, said first, second and third switches mentioned thereof consisting of the magnetic switches which are influenced by the magnetized float of the present embodiment of the invention.

So indeed may also the embodiments of the device according to the invention comprising a timing device specifically adapted for timing the evacuation of the pressurized gas (filling of the pump body), be modified to obtain a timing of the admission of the pressurized gas (delivery of the pump).

Such modifications are readly accessible to the qualified art worker and are therefore encompassed by the scope of this invention as equivalent embodiments of those specifically claimed.

In the various preferred embodiments of the invention, disclosed hereabove, the control mechanisms for opening and closing the admission and evacuation valve(s) for the pressurized gas may very suitably comprise the coil of electromagnetic valves.

In the embodiments of the invention comprising a magnetized float, said magnetized float is preferably movably provided on a central hollow spindle, made of non ferromagnetic material, in which are provided said magnetic switches, and said hollow spindle may very appropriately comprise at its lower end a baffle, in order to steady the movement of the float by acting on the filling stream of the fluid into the pump body.

In the embodiments in which the timing device is constructed with an intermittent relay, said relay most preferably is of the type with an adjustable constant period with short reloading time.

Other features and details of the invention will appear from the following description, in which reference is made to the attached drawings, showing by way of purely illustrating examples, some embodiments of specific control devices according to the invention.

DESCRIPTION OF THE PREFERRED EMBODIMENTS

Figure 1:
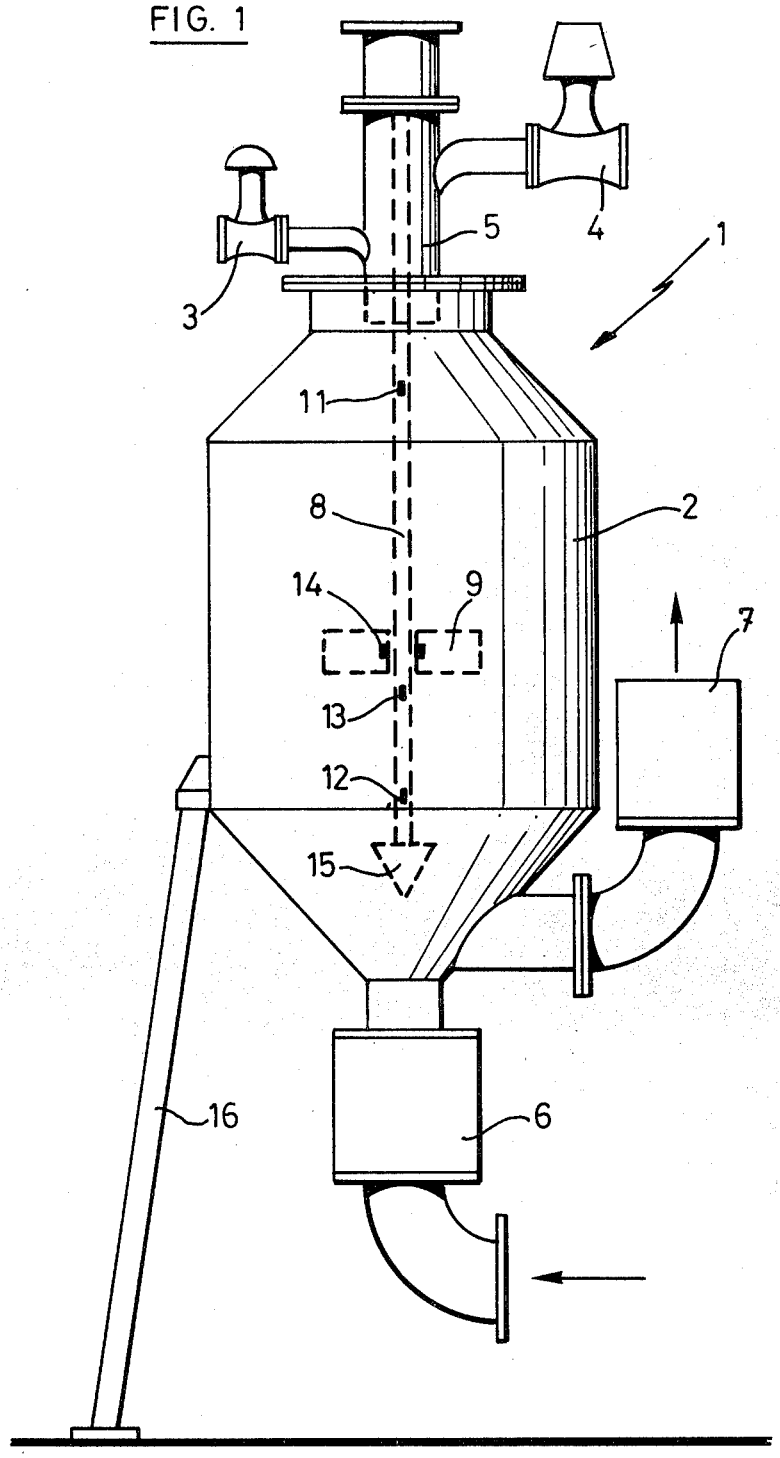
FIG. 1 is a side plan view, partially in section, of a pneumatic pump, without a membrane, with a control device according to the invention, comprising a magnetized float and magnetic switches.

The pneumatic pump with a constant volume shown in FIG. 1 indicated as a whole by the reference numeral 1, comprises:

- a vessel 2 of arbitrary shape (here represented as cylindrical and tronconical), the material of which is adapted to the kind of liquid pumped;
- two valves 3, 4 with electromagnetic control mechanism, valve 3 serving for the admission of compressed air (3) and valve 4 serving for the exhaust (evacuation) of the pump body;
- a collector 5 for the admission and evacuation of compressed air;
- two non return valves 6, 7, valve 6 being a suction valve for filling the pump body valve 7 being a delivery valve for emptying the pump body. These non return valves 6, 7 may be of any type and may in particular consist of ball boxes, etc.;
- a central hollow spindle 8, of non ferromagnetic material, in which are provided three magnetic microswitches 11, 12 and 13;
- a float 9 movably provided on said central spindle 8 and comprising a permanent magnet 14;
  - said magnet 14 serving to contact the microswitches 11, 12, 13. These microswitches are of the normally open type, and close briefly when under the influence of the magnetic field of the permanent magnet 14 when the magnet 14 is in the vicinity of the microswitches.

Such closing of the microswitches 11, 12, 13 will occur as often as the float 9, which accompanies the level of liquid (pulp, sludge, etc . . . ) in the body 2 of the pump, will be in the same horizontal plane as said microswitches. The pneumatic pump further comprises:

- a baffle 15 for the pulp, provided at the lower end of the central spindle 8. This baffle 15 is mainly intended to steady the movement of the float 9 during the filling of the pump body 2;
- an electric control assembly to operate and control the pump performance (not shown in FIG. 1, but described herebelow, by way of example, making reference to FIGS. 2 and 3)
- a frame 16 for supporting the body 2 of the pump.

Figure 2:
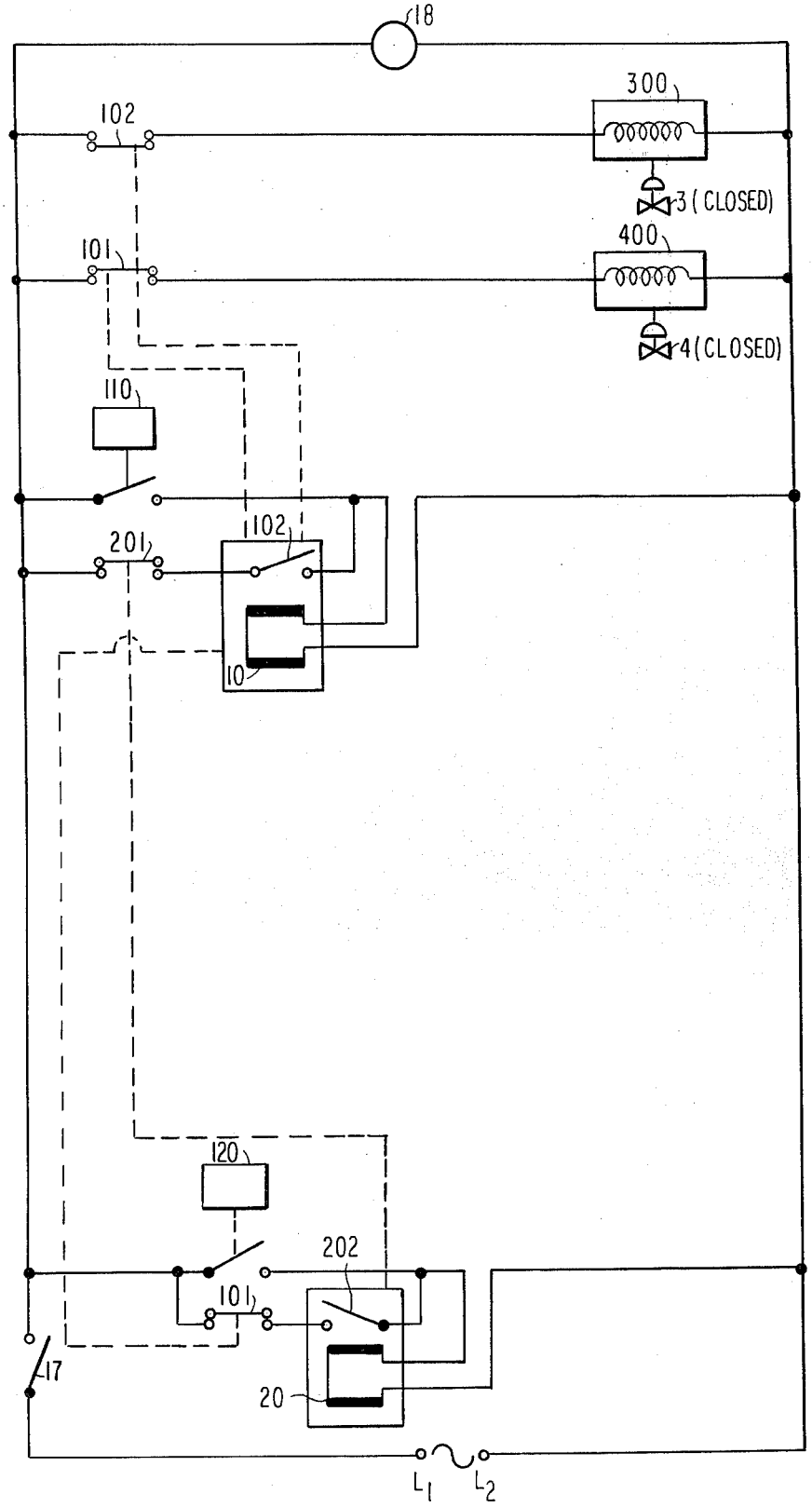
FIG. 2 is an electric diagram of an assembly adapted for the control device shown in FIG. 1 under a start condition, wherein the magnetic switches of the liquid level detectors and the contacts of the relays are in a normal non-use position.

The control of the performance of the pump shown in FIG. 1 may be achieved by means of a control and regulation device as shown schematically in FIG. 2.

The electric assembly of this control and regulation device according to the invention comprises:

- a general switch 17 for connecting to an exciting current source $L_1$, $L_2$;
- contacts 110, 120 of the magnetic microswitches 11, 12;
- the normally closed first and second contacts 101 and the normally opened first and second contacts 102 of a relay 10;
- the normally closed contact 201 and the normally opened first and second contacts 202 of a relay 20; and
- the coil 300 of a (normally closed) electromagnetic admission valve 3, and the coil 400 on a (normally closed) electromagnetic evacuation valve 4.

The assembly may further comprise a signalisation for the operation of the pump such as a lamp 18, lighting when the switch 17 is closed.

The control device shown schematically in FIG. 2 makes the pump to perform in an uninterrupted manner between the upper level of the float 9 (magnetic switch 11) and its lower level (magnetic switch 12) and provides a maximum flow rate in the following manner:

For starting the pump, one converts the pump electrically by closing the general switch 17, as shown in FIG. 2. Under the action of the current, the electromagnetic valve 4 for the evacuation of the compressed air opens and the electromagnetic valve 3 for the admission of the compressed air remains closed, as indeed the relay 10, able to be contacted by contact 110 of the upper magnetic microswitch 11 is not connected electrically to the exciting current source $L_1$, $L_2$, and therefore leaves coil 400 of valve 4 under the action of the exciting current through the normally closed contact 101 of said relay 10.

The pump body 2 fills through the non return valve 6, when the movable float 9, which accompanies the liquid level, reaches the upper level in the pump body, it causes the closing of the magnetic switch 11. This results in the feeding of relay 10, and therefore in the closing of the normally opened contact 102, so that the admission valve 3 (the coil 300 being electrically connected to the exciting current source $L_1$, $L_2$) will open and the evacuation valve 4 will close (because the normally closed contact 101 opens).

The compressed air, available at sufficient pressure and flow is thus allowed to enter the top of the pump and the liquid is consequently forced out through the delivery non return valve 7, until the float 9 reaches a lower level in the pump body and actuates the magnetic microswitch 12.

The magnetic micro-switch 12 provided at that level then reverses the process by contacting (and maintaining) relay 20 and opening contact 201 thus releasing relay 10.

The evacuation valve 4 opens (the bobin 400 being fed through the normally closed contact 101) and the admission valve 3 closes again (due to the opening of the action of an exciting current closed though contact 101). Thus the pumping cycle starts again.

This control device yields a flow which is maximal and is only influenced by the size of the pump and the suction and delivery conditions (drop of charge, density of the pumped fluid, manometric height, etc.).

Figure 3:
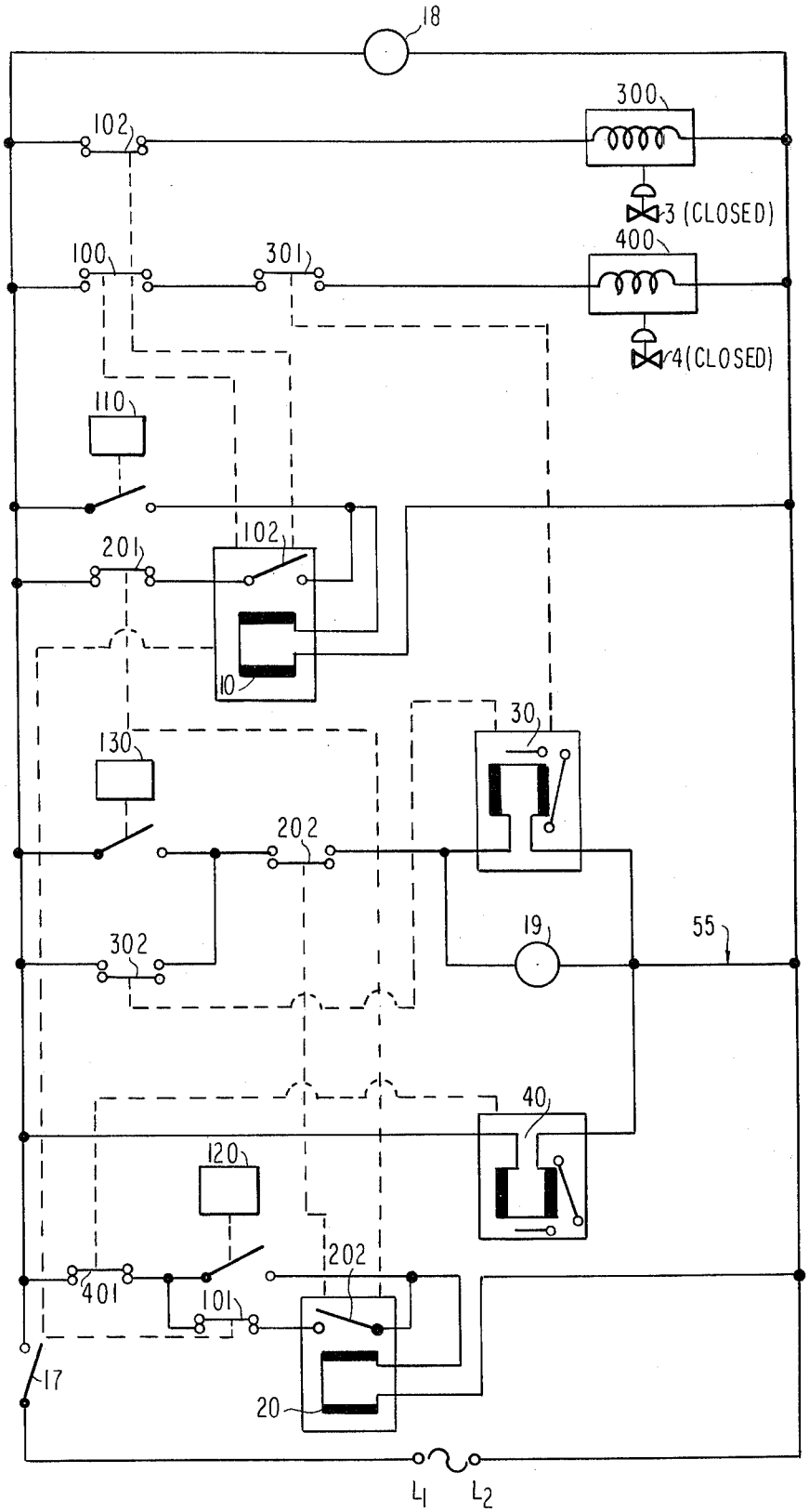
FIG. 3 is an electric diagram of an assembly adapted for a control device according to the invention comprising liquid level detectors cooperating with a timing device.

The control device schematically represented in FIG. 3 achieves a flow rate regulation (volumetric regulation of the performance of pneumatic pumps without membranes as shown in FIG. 1).

The electric assembly of this regulation device comprises:

- a general switch 17 for connecting the devise to an exciting current source $L_1$,$L_2$;
- the contacts 110, 120, 130 of magnetic microswitches 11, 12, 13;
- the normally closed first and second contacts 101 and the normally opened first and second contacts 102 of a relay 10;
- the normally closed contact 201 and the normally opened first and second contacts 202 of a relay 20;
- the normally closed contact 301 and the normally opened contact 302 of a relay 30;
- the normally closed contact 401 of an intermittent relay 40;
- the coils 300 and 400 of normally closed electromagnetic valves 3 and 4 for the admission and the evacuation of the pressurized gas respectively;

a signalization lamp 19 concerning the performance of the volumetric regulation of the device.

The assembly may furthermore comprise a signalization lamp 18 concerning the operation of the pump, lighting when the switch 17 is closed.

The assembly for the volumetric regulation of pneumatic pumps, as schematically represented on FIG. 3, adds to the performance of the device described hereabove making reference to the diagram of FIG. 2. FIG. 3 provides a timing for the duration of the opening of the evacuation valve 4 for the gas under pressure, during the filling phase of the pump performance.

This timing is achieved by means of an intermittent relay 40 which cooperates with the magnetic switch 13 for the intermediate level in the pump body, in an electric assembly, as represented schematically in FIG. 3, which causes the closing of the valve 4 when the liquid level reaches the level corresponding to the magnetic switch 13, during the filling operation. This closing of valve 4 is maintained so long that the total suction and delivery cycle of the pump performs in a time fixed by the flickering period of relay 40. The relay 40 is, preferably, of the type with an adjustable constant time, with a short reloading time. The adjustable flow rate of the pneumatic pump is then ruled by the following formula:

$$D=(V\cdot 3600)/P$$

in which:

D represents the flow rate of the pump (in liters/-hour)

V represents the volume pumped at each cycle (volume in liters, between the level of switch 11 and of switch 12)

P represents the adjustable period of the intermittent relay 40 (in seconds). The regulation device according to diagram 3 performs in the following manner:

when the pump is started by closing general switch 17, the magnetized float 9 is adjacent to the baffle stop 15, and the magnetic switches 110, 120 and 130 are all open and the various contacts are shown in FIG. 3;

when the liquid level and the magnetized float 9 reach the lowest magnetic switch 12, the magnetic switch 120 is briefly closed which supplies current to the relay 20 which closes the normally opened first and second contacts 202 and opens the normally closed contact 201, and the relay 20 remains activated subsequent to the magnetized float 9 passing away from the contact 12 since the current continues to flow through the relay 20 through closed contacts 401, 101 and 202 located in the lowermost lefthand corner of FIG. 3;

when the liquid reaches the intermediate level corresponding to the magnetic switch 13, the relay 30 is for a short time electrically connected at the source $L_1$, $L_2$ by closing of the magnetic switch 13 since the normally opened contact 202 located between the switch 130 and the relay 30 remains closed since the relay 20 remains activated due to current flowing through the closed contacts 401, 101 and 202. The relay causes the evacuation valve 4 to close (owing to the opening of the normally closed contact 301 of relay 30), whereas the admission valve 3 remains closed.

At the same time, the signalization lamp 19 concerning the volumetric regulation lights on. The two valves 3 and 4 being closed, the filling of the pump is interrupted.

When the intermittent relay 40 reaches the end of its flickering period, its normally closed contact 401 opens for the reloading time of the relay. The opening of the normally closed contact 401 interrupts current to the relay 20 which deactivates this relay causing the contacts 201 and 202 to return to the state shown in FIG. 3, that is the normally opened contacts 202 again open and the normally closed contact 201 again closes. Since one of the contacts 202 is disposed adjacent the third relay 30, the opening of this contact 202 interrupts current to the relay 30 which deactivates the relay 30 thus causing the contact 301 which is previously opened to again close and the evacuation valve 4 is opened again, allowing the filling operation of the pump to go on.

At the same time the signalization lamp 19 goes out again. The lighting of the signalization lamp 19 thus corresponds to the time during which the two valves 3 and 4 are closed simultaneously. That closing time constitutes in fact the margin between the total time of the volumetrically regulated cycle (time set on the intermittent relay 40) and the time required for one complete suction and delivery cycle of the pump, without interruption.

The lighting time of lamp 19 therefore indicates the time reserve available before reaching the maximum flow rate of the pump (normal cycle without interruption). Since the intermittent relay 40 is continuously connected to the exciting current source $L_1$, $L_2$ after the general switch 17 is closed, when the intermittent relay reaches the end of its flickering, a new flickering period is immediately restarted.

The volumetric regulation of the device according to this embodiment of the invention will therefore perform as long as the suction and delivery conditions remain such that they can allow a flow rate which is higher than the actually regulated flow rate.

There can further be provided an alarm in the assembly to signal when the real time of the normal suction and delivery cycle of the pump comes to exceed the time set on the intermittent relay.

It should on the other hand be observed that when one provides a switch in the electric assembly shown in diagram 3, at the point indicated with reference numeral 55, the performance of such device will, for the open position of that switch, be the same as the performance of the device of diagram 2.

Although the diagram 3 is specifically established for timing the duration of opening of the evacuation valve 4 for the pressurized gas (filling of the pump), it must be obvious that a similar performance may be obtained by timing the duration of the opening of the admission valve 3 of the pressurized gas (delivery of the pump).

It must finally be observed that in the diagram of FIG. 3 the switches 110, 120, 130 may be switches of any type pertaining to or influenced by any kind of detectors for the liquid level in the pump body, instead of the magnetic switches as mentioned for the embodiments of the invention specifically described hereabove.

It must thus be clear that the invention is by no means limited to the embodiments and details explicitly described and that the specialized art worker will easily find numerous modifications to said embodiments and details without leaving the general scope of the invention as set forth in the attached claims.

The electric circuit of diagram 3, disclosed as purely illustrative example, will thus for instance easily be adapted by the art worker to achieve a regulation of any type of volumetric pump, by controlling the liquid level therein.

What I claim is:

1. A device for controlling and regulating the performance of pumps having a constant volume pump body, admission and evacuation valves for admitting and evacuating a pressurized gas into and out of the pump body, and non-return valves for filling and delivering a pumped liquid into and out of the pump body, comprising:

an independent time-switch device having time impulses which are independently adjustable, the time-switch device maintaining a total duration of a complete cycle of the pump constant from one cycle to the next by varying a stop period while filling the pump body with said liquid and delivering said liquid from said pump body to compensate for varying suction and delivery duration periods thus producing a pulsating and jerky discharge;

at least three liquid level detectors in the pump body, the three level detectors being adapted to control the opening and the closing of the admission and evacuation valves for the pressurized gas.

2. The device for controlling and regulating the performance of pumps claimed in claim 1, further comprising:

a magnetized float inside the pump body, the float being adapted to move with the level of the pumped liquid according to a guided path;

the at least three detectors comprising at least three magnetic switches placed at different levels along the path of the magnetized float, the magnetic switches being adapted to be actuated by said float, and being adapted to control the opening and the closing of the admission and evacuation valves; one of the magnetic switches being located at an intermediate level along the path of the float for closing the evacuation valve;

the time-switch device controlling the opening of the evacuation valve after the evacuation valve is closed by the intermediate magnetic switch.

3. The device for controlling and regulating the performance of pumps claimed in claim 1, further comprising normally closed mechanisms for controlling the admission and evacuation valves and an electric control assembly for controlling the mechanisms, the electric control assembly comprising:

a first relay, actuated by a first relay switch actuated by the liquid level detector corresponding to an upper level of the liquid in the pump body, said first relay having normally closed first and second contacts and normally opened first and second contacts, said first relay being placed in series with said first switch;

a second relay, actuated by a second relay switch actuated by the liquid level detector corresponding to a lower level of the liquid in the pump body, the second relay having normally opened first and second contacts and a normally closed contact, said second relay being placed in series with said second switch;

a third relay, actuated by a third relay switch actuated by the liquid level detector corresponding to an intermediate level of the liquid in the pump body, the third relay having a normally closed contact and a normally opened contact, said third relay being placed in series with third switch;

an intermittent relay operating when the electric control assembly of the device is electrically connected, the intermittent relay having a normally closed contact;

the normally closed first contact of the first relay being connected in series with the normally closed contact of the third relay and being connected with the control mechanism for the opening of the evacuation valve for the pressurized gas, the normally closed second contact of the first relay being connected in series with the normally opened second contact of the second relay and in series with the second relay, the normally closed second contact of the first relay and normally opened second contact of the second relay which are connected in series being placed as a parallel first assembly to the second switch;

the normally opened first contact of the first relay being connected to the control mechanism for the opening of the admission valve for the pressurized gas, the normally opened second contact of the first relay being connected in series with the normally closed contact of the second relay and in series with the first relay, the normally closed contact of the second relay and normally opened second contact of the first relay connected in series being placed as a parallel second assembly to the first switch;

the normally opened contact of the third relay being connected in series with the normally opened first contact of the second relay and in series with the third relay, the normally opened contact of the third relay being placed as a parallel third assembly to the third switch; and the normally closed contact of the intermittent relay being connected in series with the parallel first assembly to the second switch and being connected in series with the second switch.

4. The device for controlling and regulating the performance of pumps as claimed in claim 3 wherein the normally closed mechanism for controlling the admission and evacuation valves are controlled by the electric control assembly and the first, second and third magnetic switches and the magnetized float.

5. The device for controlling and regulating the performance of pumps as claimed in claims 3 or 4, wherein the mechanisms for controlling the admission and evacuation valves for the pressurized gas comprise coils of electromagnetic valves.

6. The device for controlling and regulating the performance of pumps as claimed in claim 4, further comprising a central hollow spindle made of non-ferromagnetic material, said magnetic switches being mounted on the spindle, said magnetized float being movably guided on the spindle.

7. The device for controlling and regulating the performance of pumps as claimed in claim 6 wherein the spindle has a baffle at its lower end in order to steady the movement of the float by acting on a filling stream of the fluid filling the pump body.

8. The device for controlling and regulating the performance of pumps as claimed in claim 3 further comprising an intermittent relay, at least one of the detectors cooperating with the intermittent relay to provide a timing performance for the filling or delivery operation of the pump, the intermittent relay having an adjustable constant period with a short reloading time.

* * * * *